US009357285B2

(12) United States Patent
Wu

(10) Patent No.: US 9,357,285 B2
(45) Date of Patent: May 31, 2016

(54) EARPHONE DETECTING CIRCUIT AND PORTABLE ELECTRONIC DEVICE USING THE SAME

(71) Applicant: Chi Mei Communication Systems, Inc., New Taipei (TW)

(72) Inventor: Chun-Hua Wu, New Taipei (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 246 days.

(21) Appl. No.: 13/923,397

(22) Filed: Jun. 21, 2013

(65) Prior Publication Data

US 2014/0029759 A1 Jan. 30, 2014

(30) Foreign Application Priority Data

Jul. 26, 2012 (TW) ..... 101126886 A

(51) Int. Cl.
*H04R 1/10* (2006.01)
*H04R 29/00* (2006.01)

(52) U.S. Cl.
CPC ..... *H04R 1/1041* (2013.01); *H04R 29/00* (2013.01); *H04R 2420/09* (2013.01)

(58) Field of Classification Search
CPC ..... H04R 5/033; H04R 1/041
USPC ..... 381/74, 77–81, 84, 59
See application file for complete search history.

(56) References Cited

U.S. PATENT DOCUMENTS 5,557,237 A * 9/1996 Carpentier ..... 330/129
5,814,752 A * 9/1998 Rivera ..... G10H 1/12 330/126
8,831,241 B2 * 9/2014 Ma ..... H04R 3/007 381/74
2011/0103608 A1 * 5/2011 Wu ..... H04M 1/6058 381/74
2013/0236025 A1 * 9/2013 Ma ..... H04R 3/007 381/74
2013/0287221 A1 * 10/2013 Wu ..... H04R 1/1041 381/74

* cited by examiner

*Primary Examiner* — Disler Paul
(74) *Attorney, Agent, or Firm* — Novak Druce Connolly Bove + Quigg LLP

(57) ABSTRACT

An exemplary earphone detecting circuit includes a signal input terminal, a voltage dividing circuit, a detecting circuit, and a signal output terminal connected electronically in that order. The signal input terminal is connected to an earphone jack of a portable electronic device. The signal output terminal is connected to a microcontroller of the portable electronic device. When the portable electronic device receives a call, the signal input terminal receives a signal and transmits the received signal to the detecting circuit through the voltage dividing circuit, the detecting circuit processes the signal transmitted to the signal output terminal to be constant.

9 Claims, 1 Drawing Sheet

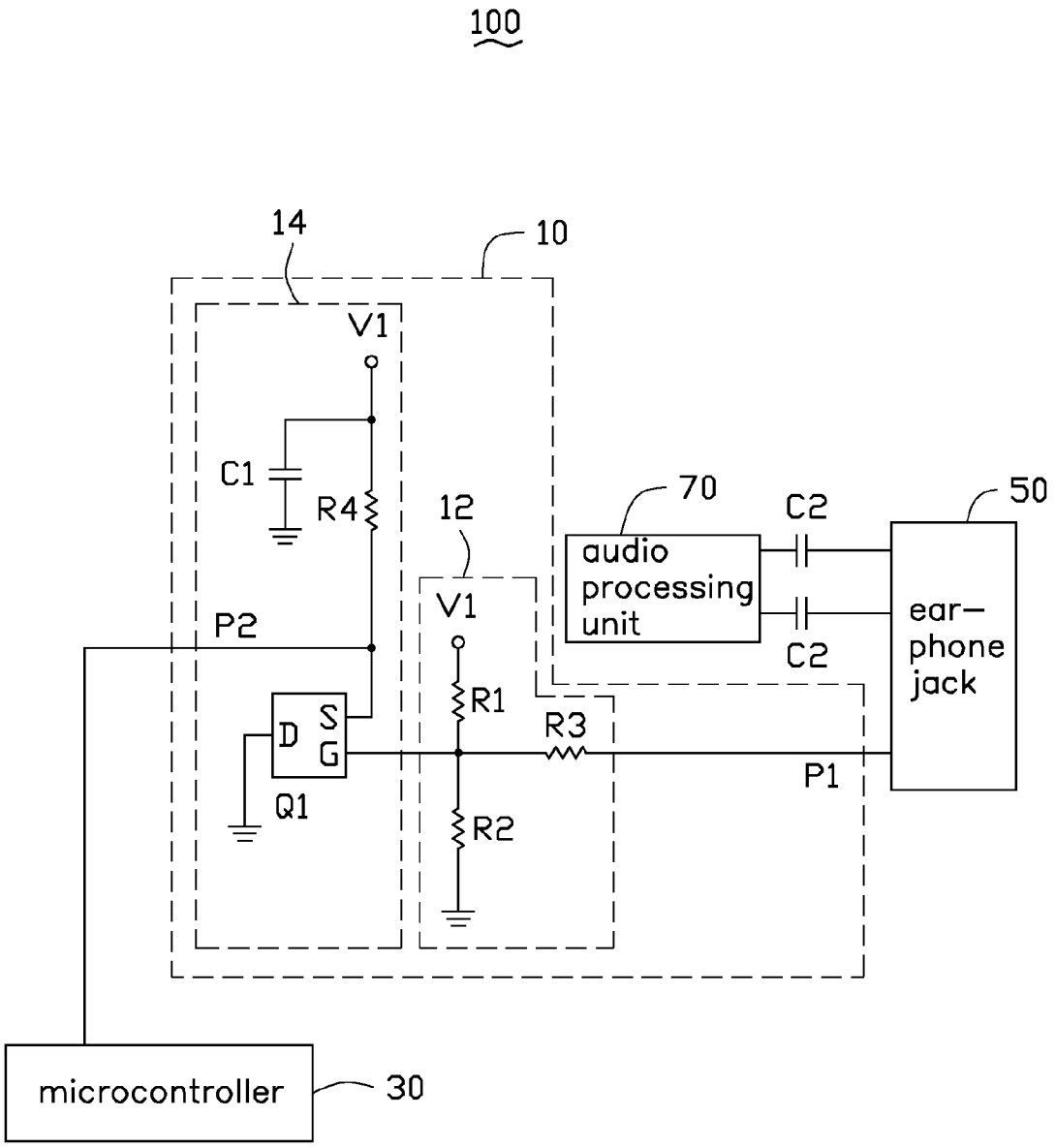
100
14
10
V1
C1
R4
12
70
C2
50
audio processing unit
ear-phone jack
V1
P2
R1
R3
D
S
G
Q1
R2
P1
C2
microcontroller
30

EARPHONE DETECTING CIRCUIT AND PORTABLE ELECTRONIC DEVICE USING THE SAME

BACKGROUND

1. Technical Field

The disclosure generally relates to earphone detecting circuits, and particularly to an earphone detecting circuit and a portable electronic device using the earphone detecting circuit.

2. Description of the Related Art

A portable electronic device, such as a mobile phone, or a personal digital assistant, commonly establishes a call via a speaker and a microphone arranged at opposite ends of the portable electronic device, or via an earphone received in an earphone jack of the portable electronic device. However, the call is often disconnected by mistake due to the earphone incompatibility with the earphone jack or interference, such as an user exhaling towards the microphone.

Therefore, there is room for improvement within the art.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views. Wherever possible, the same reference numbers are used throughout the drawings to refer to the same or like elements of an embodiment.

The FIGURE is a partial circuit diagram of a portable electronic device including an earphone detecting circuit, according to an exemplary embodiment.

DETAILED DESCRIPTION

The FIGURE is a partial circuit diagram of a portable electronic device 100, according to an exemplary embodiment. The portable electronic device 100 may be a mobile phone or a personal digital assistant, for example. In this embodiment, the portable electronic device 100 is a mobile phone.

The portable electronic device 100 includes an earphone detecting circuit 10, a microcontroller 30, and an earphone jack 50. The earphone detecting circuit 10 is connected electronically between the microcontroller 30 and the earphone jack 50. The earphone jack 50 can receive an external earphone. In this embodiment, the external earphone is configured with a microphone and inputs and outputs audio signals.

The earphone detecting circuit 10 includes a signal input terminal P1, a voltage dividing circuit 12, a detecting circuit 14, and a signal output terminal P2. The signal input terminal P1 is connected electronically to the earphone jack 50. The voltage dividing circuit 12 includes a first resistor R1, a second resistor R2, and a third resistor R3. One end of the first resistor R1 is connected to a power supply V1. Another end of the first resistor R1 is grounded through the second resistor R2. One end of the third resistor R3 is connected electronically between the first and second resistors R1, R2. Another end of the third resistor R3 is connected to the signal input terminal P1.

The detecting circuit 14 includes a transistor Q1, a fourth resistor R4, and a first capacitor C1. In this embodiment, the transistor Q1 is a p-channel metal oxide semiconductor (PMOS) transistor. A gate of the transistor Q1 is connected to the signal input terminal P1 through the third resistor R3. A drain of the transistor Q1 is grounded. A source of the transistor Q1 is connected to the power supply V1 through the fourth resistor R4. One end of the first capacitor C1 is connected between the power supply V1 and the fourth resistor R4. Another end of the first capacitor C1 is grounded. The signal output terminal P2 is connected between the fourth resistor R4 and the source of the transistor Q1.

The microcontroller 30 may be a central processing unit. The microcontroller 30 is connected electronically to the signal output terminal P2. The microcontroller 30 is for receiving a detecting signal output by the detecting circuit 10 and executing corresponding functions according the received detecting signal, for example, maintaining the call or hanging up the call.

In use, when the portable electronic device 100 is receiving a call and no earphone is received in the earphone jack 50 (i.e., the portable electronic device 100 is receiving a call with a speaker and a microphone arranged at opposite ends thereof), there is no signal output to the signal input terminal P1. Thus, the gate of the transistor Q1 is pulled up to the power supply V1 and the transistor Q1 is turned off. In this way, the signal output terminal P2 is pulled up to the power supply V1 through the fourth resistor R4 and outputs a high level signal (e.g., logic 1) to the microcontroller 30.

When the portable electronic device 100 is receiving a call and an earphone matching with the earphone jack 50 (e.g., an open mobile terminal platform (OMTP) earphone) is received in the earphone jack 50, there is a high level signal (e.g., logic 1) output to the signal input terminal P1. Thus, the transistor Q1 is turned off due to the gate of the transistor Q1 connecting to the signal input terminal P1. In this way, the signal output terminal P2 is pulled up to the power supply V1 through the fourth resistor R4 and outputs a high level signal (e.g., logic 1) to the microcontroller 30.

When the portable electronic device 100 is receiving a call, and then an unmatched earphone (e.g., a non-OMTP earphone) is received in the earphone jack 50 or the earphone matches with the earphone jack 50 but the user exhales towards the microphone, there is an instantaneous low level signal (e.g., logic 0) output to the signal input terminal P1. The voltage dividing circuit 12 receives and processes the instantaneous low level signal, thereby making a voltage difference between the gate of the transistor Q1 and the source of the transistor Q1 being less than a turn-on voltage of the transistor Q1, the transistor Q1 is still turned off. In this way, the signal output terminal P2 is pulled up to the power supply V1 through the fourth resistor R4 and outputs a high level signal (e.g., logic 1) to the microcontroller 30.

When the portable electronic device 100 is receiving a call, the microcontroller 30 receives a constant signal (i.e., a high level signal). In addition, the microcontroller 30 executes a function of maintaining the call, which can effectively stop the call from being disconnected mistakenly due to interference from the user (e.g., exhaling towards the microphone) or an unmatched earphone being inserted in the earphone jack 50.

When the call needs to be disconnected, there is a low level signal (e.g., logic 0) output to the signal input terminal P1. Thus, the gate of the transistor Q1 is grounded through the signal input terminal P1 and the transistor Q1 is turned on. In this way, the signal output terminal P2 is grounded through the transistor Q1 and outputs a low level signal (e.g., logic 0)

to the microcontroller 30. The microcontroller 30 receives the low level signal and is triggered to execute a function of hanging up the call.

The portable electronic device 100 further includes an audio processing unit 70. The audio processing unit 70 is connected electronically to the earphone jack 50 through two capacitors C2, C3 which are connected in parallel. The audio processing unit 70 amplifies audio signal from the earphone jack 50, thereby improving signal quality.

In summary, the portable electronic device of this embodiment of the disclosure has a simple circuit structure and can effectively avoid hanging up the call by mistake due to interference from the user, such as exhaling towards the microphone, or an unmatched earphone inserted in the earphone jack, thereby obtaining a better communication quality.

In the present specification and claims, the word "a" or "an" preceding an element does not exclude the presence of a plurality of such elements. Further, the word "comprising" does not exclude the presence of elements or steps other than those listed.

It is to be also understood that even though numerous characteristics and advantages of exemplary embodiments have been set forth in the foregoing description, together with details of the structures and functions of the embodiments, the disclosure is illustrative only, and changes may be made in detail, especially in matters of arrangement of parts within the principles of this disclosure to the full extent indicated by the broad general meaning of the terms in which the appended claims are expressed.

What is claimed is:

1. An earphone detecting circuit for a portable electronic device comprising an earphone jack and a microcontroller, the earphone detecting circuit comprising:

a signal input terminal connected to the earphone jack;

a voltage dividing circuit connected to the signal input terminal;

a detecting circuit connected to the voltage dividing circuit; and a signal output terminal connected between the detecting circuit and the microcontroller; wherein the detecting circuit comprises a transistor, a resistor, and a first capacitor, a gate of the transistor is connected to the signal input terminal through the voltage dividing circuit; a drain of the transistor is grounded; a source of the transistor is connected to a power supply through the resistor; one end of the first capacitor is connected between the power supply and the resistor of the detecting circuit, another end of the first capacitor is grounded; the signal output terminal is electronically connected between the resistor and the source of the transistor, when the portable electronic device is receiving a call, the signal input terminal receives a signal and transmits the received signal to the detecting circuit through the voltage dividing circuit, the detecting circuit controls the signal transmitted to the signal output terminal to be a constant signal.

2. The earphone detecting circuit of claim 1, wherein the voltage dividing circuit comprises a first resistor, a second resistor, and a third resistor, one end of the first resistor is connected to the power supply, another end of the first resistor is grounded through the second resistor; one end of the third resistor is connected electronically among the first resistor, a second resistor, and the gate of the transistor, and another end of the third resistor is connected to the signal input terminal.

3. The earphone detecting circuit of claim 1, wherein the microcontroller maintains the call by an instantaneous low level signal output to the signal input terminal causing turning off the transistor and the signal output terminal be pulled up to the power supply through the resistor of the detecting circuit.

4. The earphone detecting circuit of claim 1, wherein the microcontroller hangs up the call by a low level signal output to the signal input terminal causing the gate of the transistor to be grounded through the signal input terminal, turning on the transistor, and grounding the signal output terminal through the transistor.

5. A portable electronic device, comprising:

an earphone jack;

a microcontroller; and an earphone detecting circuit, comprising:

a signal input terminal connected to the earphone jack;

a voltage dividing circuit connected to the signal input terminal;

a detecting circuit connected to the voltage dividing circuit; and a signal output terminal connected between the detecting circuit and the microcontroller; wherein the detecting circuit comprises a transistor a resistor, and a first capacitor, a gate of the transistor is connected to the signal input terminal through the voltage dividing circuit; a drain of the transistor is grounded; a source of the transistor is connected to a power supply through the resistor; one end of the first capacitor is connected between the power supply and the resistor of the detecting circuit, another end of the first capacitor is grounded; the signal output terminal is electronically connected between the resistor and the source of the transistor, when the portable electronic device is receiving a call, the signal input terminal receives a signal and transmits the received signal to the detecting circuit through the voltage dividing circuit, the detecting circuit controls the signal transmitted to the signal output terminal to be a constant signal.

6. The portable electronic device of claim 5, wherein the voltage dividing circuit comprises a first resistor, a second resistor, and a third resistor, one end of the first resistor is connected to the power supply, another end of the first resistor is grounded through the second resistor; one end of the third resistor is connected electronically among the first resistor, a second resistor, and the gate of the transistor, another end of the third resistor is connected to the signal input terminal.

7. The portable electronic device of claim 5, wherein the microcontroller maintains the call by an instantaneous low level signal output to the signal input terminal causing turning off the transistor and the signal output terminal be pulled up to the power supply through the resistor of the detecting circuit.

8. The portable electronic device of claim 5, wherein the microcontroller hangs up the call by a low level signal output to the signal input terminal causing the gate of the transistor to be grounded through the signal input terminal, turning on the transistor, and grounding the signal output terminal through the transistor.

9. The portable electronic device of claim 5, further comprising an audio processing unit, wherein the audio processing unit is connected electronically to the earphone jack through two capacitors which are connected in parallel.

* * * * *